US008777575B2

(12) United States Patent
Forsstrom

(10) Patent No.: US 8,777,575 B2
(45) Date of Patent: Jul. 15, 2014

(54) METHOD AND ARRANGEMENT FOR PROPELLER PITCH CONTROL

(75) Inventor: Jan-Olov Forsstrom, Kristinehamn (SE)

(73) Assignee: Rolls-Royce Aktiebolag (SE)

( * ) Notice: Subject to any disclaimer, the term of this patent is extended or adjusted under 35 U.S.C. 154(b) by 529 days.

(21) Appl. No.: 13/124,418

(22) PCT Filed: Oct. 12, 2009

(86) PCT No.: PCT/SE2009/051151

§ 371 (c)(1),
(2), (4) Date: Apr. 18, 2011

(87) PCT Pub. No.: WO2010/044733

PCT Pub. Date: Apr. 22, 2010

(65) Prior Publication Data

US 2011/0200433 A1 Aug. 18, 2011

(30) Foreign Application Priority Data

Oct. 16, 2008 (SE) ..... 0850038

(51) Int. Cl.
*B63H 3/02* (2006.01)

(52) U.S. Cl.
USPC ..... 416/162; 416/165

(58) Field of Classification Search
USPC ..... 416/1, 152, 153, 162, 159, 163, 164, 416/165, 166
See application file for complete search history.

(56) References Cited

U.S. PATENT DOCUMENTS

| | | | | |
|---|---|---|---|---|
| 2,675,084 A | | 4/1954 | Nichols | |
| 5,498,135 A | | 3/1996 | Stallard, III | B63H 3/02 |
| 5,795,132 A | * | 8/1998 | Wheeler | 416/147 |

FOREIGN PATENT DOCUMENTS

| | | | | |
|---|---|---|---|---|
| GB | 822469 | * | 10/1959 | |
| GB | 2016598 | | 9/1979 | B63H 3/06 |
| WO | WO 96/31393 | | 10/1996 | B64C 11/34 |

OTHER PUBLICATIONS

International Search Report for Application No. PCT/SE2009/051151 published Apr. 22, 2010.
Written Opinion for Application No. PCT/SE2009/051151 mailed Jan. 21, 2010.

* cited by examiner

*Primary Examiner* — Edward Look
*Assistant Examiner* — Juan G Flores
(74) *Attorney, Agent, or Firm* — Eric Sophir; Dentons US LLP

(57) ABSTRACT

This invention relates to a method and a Propeller Pitch Control Arrangement, comprising a propeller hub (1) having a number of interface fittings (10) for adjustable pitch positioning of a propeller blade, a positioning device (3), within said hub (1), having a number of propeller control interfaces (34) and an actuator arrangement (2, 4, 55) arranged to move and position said positioning device (3) to enable varying pitch for said propeller blades, characterized in—that said actuator arrangement includes a rotatable shaft (2) with threads (20) interacting with mating threads (30) at said positioning device (3), and,—that said rotatable shaft (2) is driven by a motor device (4, 5) positioned adjacent said hub (1).

5 Claims, 3 Drawing Sheets

METHOD AND ARRANGEMENT FOR PROPELLER PITCH CONTROL

CROSS-REFERENCE TO RELATED APPLICATIONS

This application claims priority to PCT/SE2009/051151, filed Oct. 12, 2009, entitled "METHOD AND ARRANGEMENT FOR PROPELLER PITCH CONTROL," which claims priority to Swedish Patent Application No. 0850038-1, filed Oct. 16, 2008, entitled "METHOD AND ARRANGEMENT FOR PROPELLER PITCH CONTROL," all of which are incorporated by reference in their entirety.

TECHNICAL FIELD

This invention relates to a method and a Propeller Pitch Control Arrangement, comprising a propeller hub having a number of interface fittings for adjustable pitch positioning of a propeller blade, a positioning device, within said hub, having a number of propeller control interfaces and an actuator arrangement arranged to move and position said positioning device to enable varying pitch for said propeller blades.

BACKGROUND

The use of propellers providing adjustable pitch is of importance regarding many ships, to enable optimization of the propulsion. A conventional system to arrange for adjustability of the pitch of the propellers is based on a rather powerful hydraulic system. For many ships hydraulic systems requiring about 30 kW power are needed. It is evident that such a large need output of power implies disadvantages. This is especially apparent taking into account that there is always some leakage in big hydraulic systems and therefore the system has to be up and running more or less continuously, not at least to achieve sufficient cooling. As a consequence such an hydraulic system is rather costly. Moreover it leads to the creation of noise, which in many installations is undesired. Furthermore it necessitates a rather complex shaft design, since the shaft has to enable both supply and drainage from the two pressure chambers used in connection with a hydraulic piston that actuates positioning of the propeller pitch adjustment device. Finally it is also a hazardous design with regard to the environment, since it may lead to leakage of oil into the nature.

From U.S. Pat. No. 5,498,135 there is known a Propeller Pitch Control Arrangement, comprising a propeller hub having a number of interface fittings for adjustable pitch positioning of a propeller blade, a positioning device, within said hub, having a number of propeller control interfaces and an actuator arrangement, comprising a motor device (in the form of an electrical motor) positioned adjacent said hub, arranged to move and position said positioning device to enable varying pitch for said propeller blades. However, this known solution uses a reduction gear in combination with a drive spool and pitch ring, which makes the design bulky and complex, which probably is the reason why that design concept has not been any success. Also WO9631390 and US 20040157509, in a similar manner present solutions that are bulky and complex, e.g. by the use of a non-unitary hub body in WO9631390 and by the use of an adjustment device forming multiple bodies in US 20040157509.

SUMMARY OF THE INVENTION

It is an object of the invention to eliminate or at least minimize the problem mentioned above, which is achieved by means of a method and an arrangement according to the independent claims.

Thanks to the invention there is created an arrangement that requires considerably less power in-put compared to conventional systems and which is both compact and relatively simple in its design. As a consequence the arrangement would be considerably less costly both initially and also during use. Moreover it will facilitate a much more reliable solution regarding environmental aspects such as elimination of oil leakage. Furthermore it provides an arrangement that is much less noisy than conventional systems. All in all the new arrangement provides synergistic advantages that must be seen as surprising. Especially in combination with the use of a self braking transmission between the pitch adjustment device and the rotatable shaft these advantages are indeed surprising, since thanks to the use of a self braking interaction there will be no need for any other additional means to safe guard control to achieve a desired positioning, enabling a very compact design.

Further aspects and advantages of the invention will be more apparent in relation to the following detailed description.

DETAILED DESCRIPTION

Figure 1:
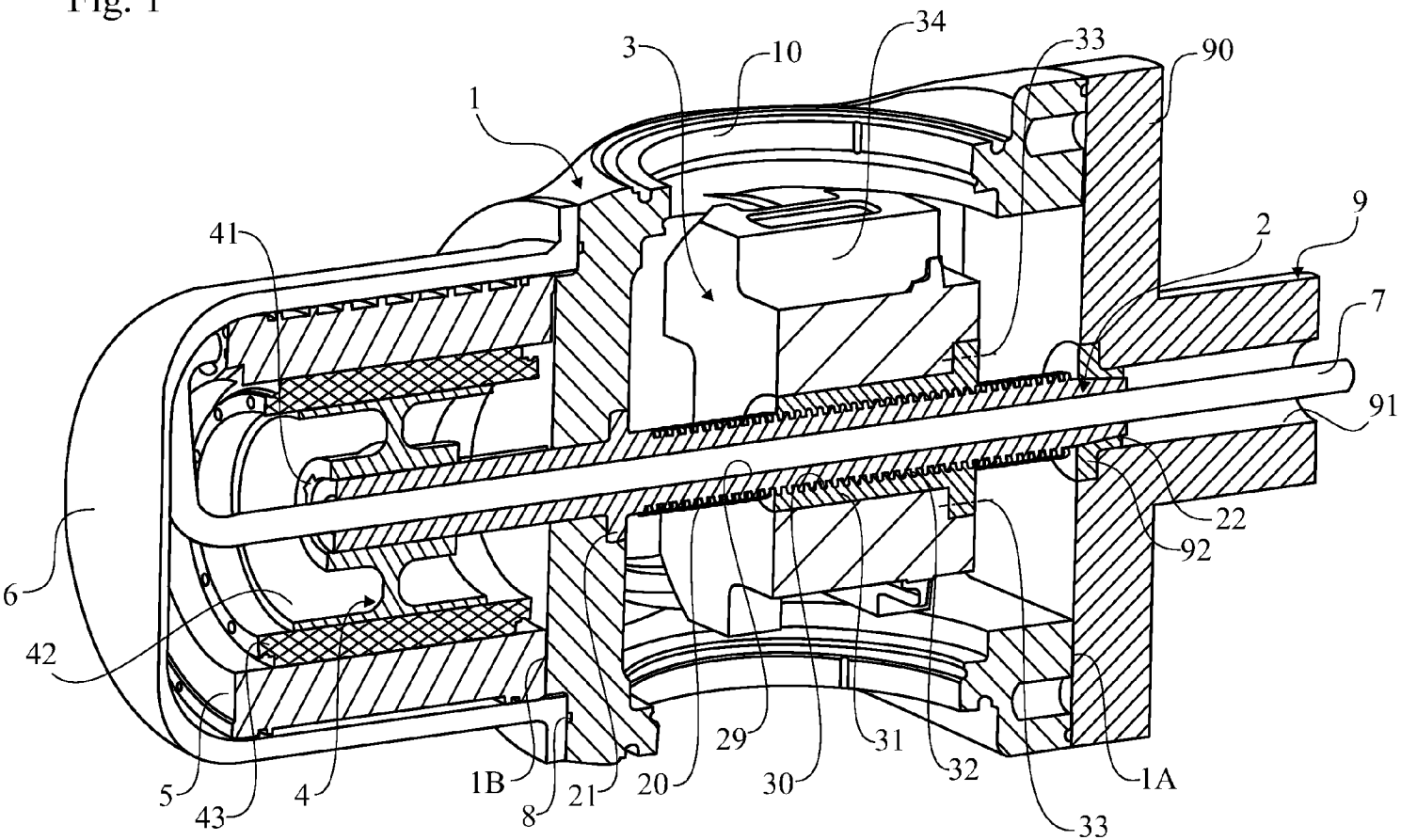
In FIG. 1 there is shown a cross-sectional view of first embodiment of an arrangement according to the invention, in FIG. 2 there is shown an exploded view of the arrangement shown in FIG. 1, and in FIG. 3 there is shown a further embodiment of the invention in a cross-sectional view.

In FIG. 1 there is shown a propeller hub 1 having four interface fittings 10 for propeller blades (not shown). The hub 1 present a hub body in the form of a unitary piece, that is fixedly attached to a propeller shaft 9 by means of a flange 90. A rotatable power shaft 2 is arranged coaxially with the propeller shaft 9, having one end 22 rotatably fixed to a bearing 31 in the end of the propeller shaft 9 and another bearing device 21 arranged in the outer wall 1B of the propeller hub 1. The power shaft 2 protrudes through the outer wall 1B where it is attached at its end to a motor 4, by means of a conventional coupling device 41 (e.g. cotter joint). The motor 4 is an electrical motor powered by means of electrical cables 7 passing through a central bore 91 of the propeller shaft 9 and also through a central bore 29 in the power shaft 2. The motor 4, in a conventional manner comprises a stator 45 that is fixedly attached to the hub 1, either directly to the outer hub wall 1B and/or to a motor cover 6 that is also fixedly attached to the outer wall 1B. The rotor 42, 43 comprises an inner cylindrical portion 42 (locked to the shaft by means of 41) and windings 43 connected thereto.

The power shaft 2 is arranged with outer threads 20 and passes through a nut device 31 having mating threads 30. The nut device 31 is fixedly attached (e.g. by means of screws 33) to the pitch adjustment device 3, which is centrally arranged within the hub 1. As can be noted the pitch adjustment device 3 presents a body unit, having the nut device 31 centrally positioned and which body directly interacts with each one of the propeller blades, by means of its eccentrically positioned interface arrangements 34. Accordingly by rotation of the rotor 42, 43 of the motor 4 the shaft 2 will rotate and force the pitch control device 3 to move linear forward or backward, depending on direction of rotation. Upon movement of the propeller pitch control device 3, interface arrangements 34 that eccentrically and directly interact with each one of the propeller blades will lead to adjustment of the pitch of each propeller, by rotation within the hub interface arrangement 10. Thanks to the use of self braking interaction between the threads 20, 30 an exact positioning of the propeller pitch adjustment device 3 may be achieved upon stop of supply of power, since the pitch adjustment device 3 will then stop exactly in the desired position without any delay.

Figure 2:
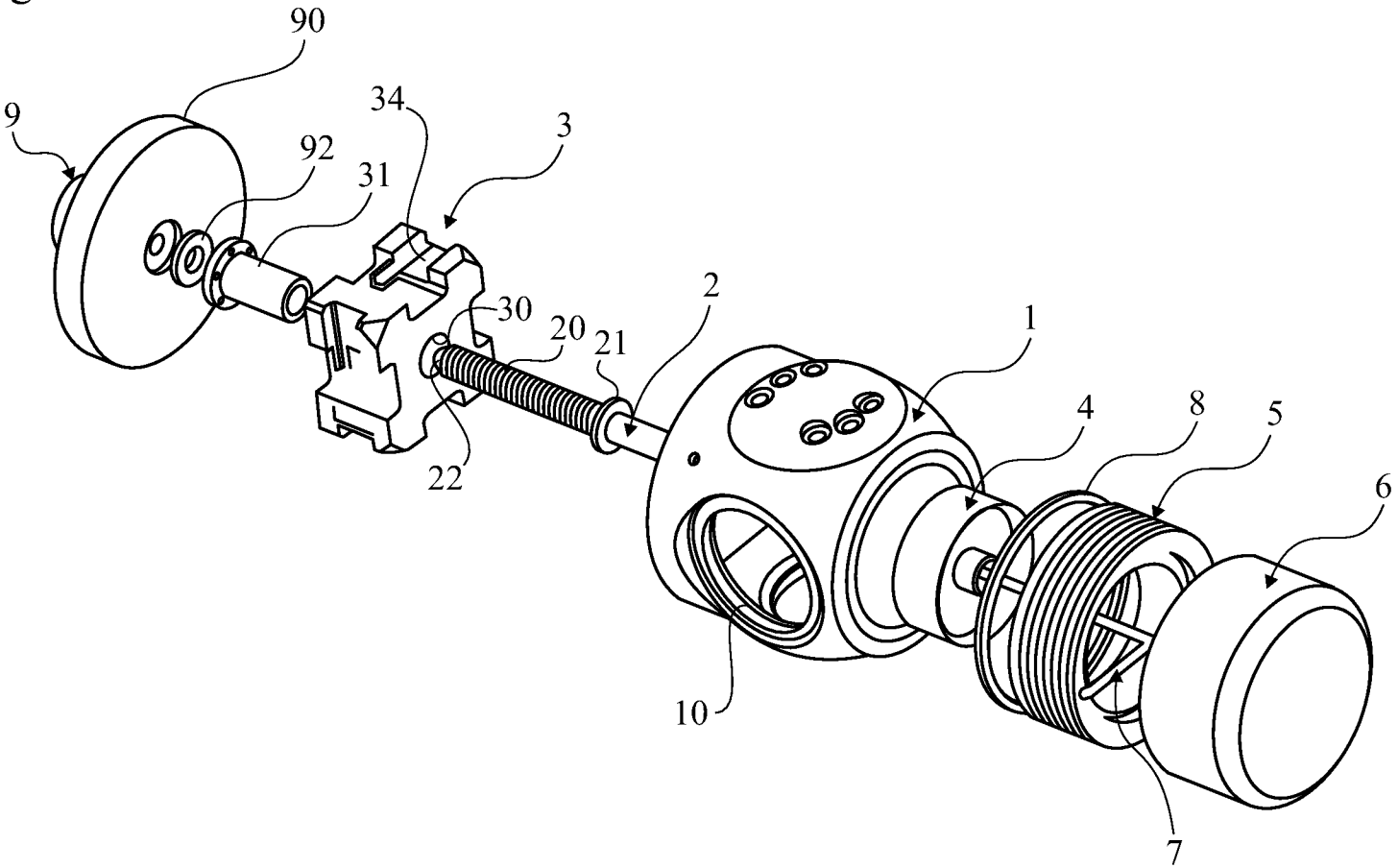

In FIG. 2 there is shown an exploded view of the embodiment according to the invention shown in cross-section in FIG. 1. Most of the details shown in the exploded view have already been explained with reference to FIG. 1 and will need no further explanation. However in the exploded view a sealing 8 used to seal between the hub 1 and the motor cover 6 is shown in more detail. An advantage that is evident from the view of this exploded view is that many of the details used for this new pitch control adjustment arrangement are the same as those used in a conventional system. For instance the pitch control device 3, the hub 1, the interface 10 and 34 may advantagely be of the same kind as those used in known systems, which allows for cost efficient concept. As can be seen, thanks to the use of a self braking interaction between the threads 20, 30 the motor 4 may fit into a relatively small space, enabling a motor cover 6 that is smaller in diameter than the hub 1.

Figure 3:
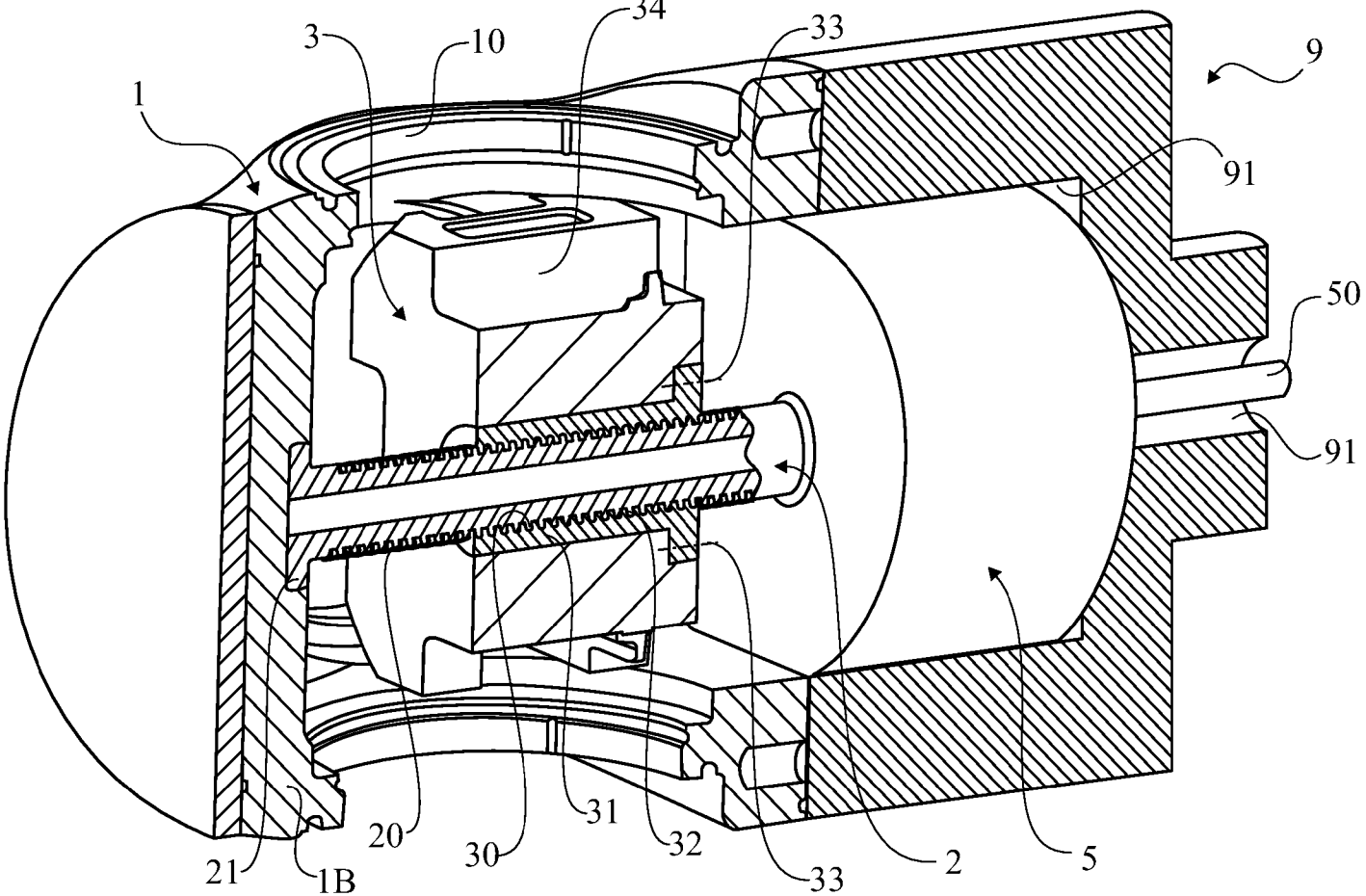

In FIG. 3 there is shown a further embodiment according to the invention which in many aspects is similar to what is described above. A major difference is that in the embodiment shown in FIG. 3 there is indicated that instead of an electrical motor 4 there is used a hydraulic motor 5. The hydraulic motor is supplied with hydraulic oil by means of a pair of channels passing through the central bore 91 of the propeller shaft 9 within a tubing 50. The power shaft 2 is fixedly attached to the hydraulic motor 4 which may rotate the power shaft 2 clockwise or anti-clockwise depending on which supply direction of the oil is used, as is known per se. Accordingly exactly the same kind of functionality is used to move and position the pitch control device 3 in this embodiment as in the one described above. Thanks to the positioning of the motor 5 at that side 1A of the hub 1 which faces the propeller shaft 9 the longitudinal extension of the hub 1 will not be longer than a conventional arrangement. Instead, there is formed a space 91 within the end portion of the propeller shaft 9, wherein the motor 5 is housed. Accordingly this embodiment provides for a very compact design.

The invention is not limited by what has been described above but may be varied within the scope of the appended claims. For the skilled person it is evident that indeed also an electric motor may be used in the concept as shown in FIG. 3 and vice versa a hydraulic motor 5 in FIG. 1. Moreover it is evident that the basic principles of the invention may also be used in connection with interacting threads not providing self braking, in at least some installations. Further it is evident that many other variations may be used without departing from the general principles of the invention, e.g. diving of the propeller shaft into different sections (e.g. to enable easy production of a motor space 91), the use of different materials depending on specific needs/desires, etc. Further it is evident that in most applications the invention will be used in connection a control system, including some kind of processor device interacting with some sensor device to control pitch of said propeller blades in an automatic or semi-automatic manner. In that regard it is evident to the skilled person that many different kinds of sensor means may be used for detecting the position of at least one propeller and/or the positioning device 3, and/or one or more parts of the actuator arrangement 2, 4, 5. The sensors may in a preferred mode use the same kind of wiring as for other electric means, e.g. the electrical motor 4.

The invention claimed is:

1. A propeller pitch control arrangement comprising:

a propeller hub having a number of interface fittings for adjustable pitch positioning of a propeller blade, a positioning device, within said hub, having a number of propeller control interfaces and an actuator arrangement arranged to move and position said positioning device to enable varying pitch for said propeller blades, wherein said actuator arrangement is driven by a motor device positioned adjacent said hub, wherein the actuator arrangement includes a single rotatable shaft with threads interacting with mating threads at the positioning device that are arranged to be self braking, and wherein the motor device is positioned coaxially in relation to the axis of the propeller shaft driving the propeller hub and in a space formed at the side of the hub facing the propeller shaft.

2. The arrangement according to claim 1, wherein the hub has a hub body in the form of a unitary piece.

3. The arrangement according to claim 1, wherein the space is formed by a cavity in the end of the shaft.

4. The arrangement according to claim 1, wherein at least one of the bearing locations for the shaft is arranged in a wall of the hub located at the opposite side in relation to the propeller shaft.

5. The arrangement according to claim 1, wherein the positioning device has a body that forms a unitary piece.

* * * * *